US006135590A

United States Patent [19]

Saeki et al.

[11] Patent Number: 6,135,590

[45] Date of Patent: Oct. 24, 2000

[54] INK CARTRIDGE CAPABLE OF PREVENTING LEAK OF INK

[75] Inventors: Tomoya Saeki; Tadashi Mizoguchi; Junichi Suetsugu; Hitoshi Minemoto; Hitoshi Takemoto; Kazuo Shima; Yoshihiro Hagiwara; Toru Yakushiji, all of Niigata, Japan

[73] Assignee: NEC Corporation, Tokyo, Japan

[21] Appl. No.: 09/058,104

[22] Filed: Apr. 9, 1998

[30] Foreign Application Priority Data

Apr. 9, 1997 [JP] Japan ..... 9-090542

[51] Int. Cl.[7] ..... B41J 2/175

[52] U.S. Cl. ..... 347/86

[58] Field of Search ..... 347/5, 7, 36, 85, 347/86, 87

[56] References Cited

U.S. PATENT DOCUMENTS

| | | | |
|---|---|---|---|
| 4,183,031 | 1/1980 | Kyser et al. | 347/86 |
| 4,700,202 | 10/1987 | Kuranishi et al. | 347/86 |
| 5,650,811 | 7/1997 | Seccombe et al. | 347/85 |
| 5,903,294 | 5/1999 | Abe et al. | 347/87 |

FOREIGN PATENT DOCUMENTS

| | | | |
|---|---|---|---|
| 0 640 484 A2 | 8/1994 | European Pat. Off. . | |
| 0 739 741 A2 | 4/1996 | European Pat. Off. . | |
| 44 11 873 A1 | 4/1994 | Germany . | |
| 58-108153A | 6/1983 | Japan | 347/36 |
| 7-68772 | 3/1995 | Japan . | |
| 125232 | 5/1995 | Japan . | |

*Primary Examiner*—N. Le
*Assistant Examiner*—Anh T. N. Vo
*Attorney, Agent, or Firm*—Hutchins, Wheeler & Dittmar

[57] ABSTRACT

In an ink cartridge which is attached to a cartridge attaching part having a joint hollow needle, a case has a case internal surface which defines a receiving space and a front wall having a front wall internal surface which defines a first associating hole. A separating wall has a separating wall internal surface which defines a second associating hole which is associated with the receiving space. A first separating wall side surface of the separating wall and a first part of the case internal surface defines an ink receiving space which receives an ink. A second separating wall side surface of the separating wall and a second part of the case internal surface defines a leak ink accepting space. A joint film has elasticity and is formed on the separating wall internal surface to be positioned in the second associating hole. The joint film is able to be passed through by the joint hollow needle. A leak ink accepting member is positioned in the leak ink accepting space. The leak ink accepting member absorbs and holds a leak ink from the ink receiving space. The leak ink accepting member is able to be passed through by the joint hollow needle. An ink cleaning film may be formed on the front wall internal surface. An ink receiving bag may be positioned in the ink receiving space.

21 Claims, 3 Drawing Sheets

INK CARTRIDGE CAPABLE OF PREVENTING LEAK OF INK

BACKGROUND OF THE INVENTION

This invention relates to an ink cartridge which is used in an electrostatic ink jet recording device such as an ink printer.

Description of the Related Art

Generally, the ink printer comprises a recording head and an ink supplying device which supplies an ink to the recording head. The ink supplying device uses a simple ink or an ink cartridge.

A conventional ink cartridge of the type described is disclosed in Japanese Unexamined Patent Prepublication (koukai) No. 125232/1995. The conventional ink cartridge has an opening part which supplies an ink and is sealed by a negative pressure producing member. Sealing of the opening part is secured by compressing the negative pressure producing member by means of an ink supplying pipe. Thereby, it is possible to prevent leak of the ink by using a negative pressure of the negative pressure producing member. In addition, the conventional ink cartridge further has an atmosphere associating part which is sealed by the negative pressure producing member. Thereby, it is possible to accommodate leak of the ink that is caused by temperature rise, atmospheric pressure drop, or expansion of an ink or an air of an internal of the ink cartridge.

However, the conventional ink cartridge does not consider a counterplan as regards deformation of the ink cartridge that is caused by such as an external pressure. Also, the conventional ink cartridge has not vibration absorbing means and impact buffering means. It may well be that leak of the ink from the opening part for supplying the ink is caused when the conventional ink cartridge is carelessly extracted from a cartridge attaching part. This is because the conventional ink cartridge is premised on making full use of the ink after the conventional ink cartridge is once set. In addition, the conventional ink cartridge has a disadvantage that the ink is adhered to a body or a clothes of a user when the body or the clothes is in contact with the opening part for supplying the ink. This is because the opening part for supplying the ink has not protecting means.

In order to solve the disadvantage, another conventional ink cartridge is disclosed in Japanese Unexamined Patent Prepublication (koukai) No. 68772/1995. The other conventional ink cartridge comprises an ink holding member which receives and holds the ink. The ink holding member is positioned in a bottom of the ink cartridge, a vicinity of an ink supplying pipe, or a cartridge attaching part. Also, the other conventional ink cartridge considers a counterplan as regards pollution of such as an ink delivery port surface, an internal of a recording device, or plain paper as a recording medium.

However, the other conventional ink cartridge has a disadvantage that the ink is adhered to the body or the clothes of the user when the body or the clothes is in contact with the ink holding member at a time of exchanging the ink cartridge. Also, the other conventional ink cartridge has a disadvantage that pollution of the bottom of the ink cartridge, the vicinity of the ink supplying pipe, or the cartridge attaching part is caused in case that the other conventional ink cartridge has the ink holding member is positioned in the vicinity of the ink supplying pipe or the cartridge attaching part. In this event, the ink holding member is not combined with the other conventional ink cartridge. Therefore, the ink of the ink holding member is not eliminated at the time of exchanging the ink cartridge even when leak of the ink is caused.

SUMMARY OF THE INVENTION

It is therefore an object of this invention to provide an ink cartridge which is capable of preventing leak of an ink.

It is another object of this invention to provide an ink cartridge which is capable of preventing pollution of the ink cartridge and a body and a clothes of a user at a time of using or exchanging the ink cartridge.

Other objects of this invention will become clear as the description proceeds.

According to a first aspect of this invention, there is provided an ink cartridge which is attached to a cartridge attaching part having a joint hollow needle which is associated with a recording head, the ink cartridge comprising:

a case attached to the cartridge attaching part and having a case internal surface which defines a receiving space, the case having a front wall opposing to the joint hollow needle, the front wall having a front wall internal surface which defines a first associating hole opposing to the joint hollow needle, the first associating hole being able to be passed through by the joint hollow needle;

a separating wall formed on a middle part of the case internal surface, the separating wall having a separating wall internal surface which defines a second associating hole which is associated with the receiving space, the second associating hole opposing to the first associating hole, the second associating hole being able to be passed through by the joint hollow needle;

a first separating wall side surface of the separating wall and a first part of the case internal surface defining an ink receiving space which receives an ink, a second separating wall side surface of the separating wall and a second part of the case internal surface defining a leak ink accepting space which is associated with the first and second associating holes and the ink receiving space;

a joint film having elasticity and formed on the separating wall internal surface to be positioned in the second associating hole, the joint film being able to be passed through by the joint hollow needle; and a leak ink accepting member positioned in the leak ink accepting space for absorbing and holding a leak ink from the ink receiving space, the leak ink accepting member being able to be passed through by the joint hollow needle.

According to a second aspect of this invention, there is provided an ink cartridge which is attached to a cartridge attaching part having a joint hollow needle which is associated with a recording head, the ink cartridge comprising:

a case attached to the cartridge attaching part and having a case internal surface which defines a receiving space, the case having a front wall opposing to the joint hollow needle, the front wall having a front wall internal surface which defines a first associating hole opposing to the joint hollow needle, the first associating hole being able to be passed through by the joint hollow needle;

a separating wall formed on a middle part of the case internal surface, the separating wall having a separating wall internal surface which defines a second associating hole which is associated with the receiving space, the second associating hole opposing to the first associating hole, the second associating hole being able to be passed through by the joint hollow needle; a first separating wall side surface of the separating wall and a first part of the case internal surface defining an ink receiving space which receives an ink, a second separating wall side surface of the separating wall and a second part of the case internal surface defining a leak ink accepting space which is associated with the first and second associating holes and the ink receiving space; and a joint film having elasticity and formed on the separating wall internal surface to be positioned in the second associating hole, the joint film being able to be passed through by the joint hollow needle; and an ink cleaning film having elasticity and water repellent and formed on the front wall internal surface to be positioned in the first associating hole, the ink cleaning film being able to be passed through by the joint hollow needle, the ink cleaning film cleaning the joint hollow needle when the joint hollow needle is extracted from the ink cleaning film.

According to a third aspect of this invention, there is provided an ink cartridge which is attached to a cartridge attaching part having a joint hollow needle which is associated with a recording head, the ink cartridge comprising:

a case attached to the cartridge attaching part and having a case internal surface which defines a receiving space, the case having a front wall opposing to the joint hollow needle, the front wall having a front wall internal surface which defines a first associating hole opposing to the joint hollow needle, the first associating hole being able to be passed through by the joint hollow needle;

a separating wall formed on a middle part of the case internal surface, the separating wall having a separating wall internal surface which defines a second associating hole which is associated with the receiving space, the second associating hole opposing to the first associating hole, the second associating hole being able to be passed through by the joint hollow needle: a first separating wall side surface of the separating wall and a first part of the case internal surface defining an ink receiving space which receives an ink, a second separating wall side surface of the separating wall and a second part of the case internal surface defining a leak ink accepting space which is associated with the first and second associating holes and the ink receiving space: and a joint film having elasticity and formed on the separating wall internal surface to be positioned in the second associating hole, the joint film being able to be passed through by the joint hollow needle;

a leak ink accepting member positioned in the leak ink accepting space for absorbing and holding a leak ink from the ink receiving space, the leak ink accepting member being able to be passed through by the joint hollow needle; and an ink cleaning film having elasticity and water repellent and formed on the front wall internal surface to be positioned in the first associating hole, the ink cleaning film being able to be passed through by the joint hollow needle, the ink cleaning film cleaning the joint hollow needle when the joint hollow needle is extracted from the ink cleaning film.

According to a fourth aspect of this invention, there is provided an ink cartridge which is attached to a cartridge attaching part having a joint hollow needle which is associated with a recording head, the ink cartridge comprising:

a case attached to the cartridge attaching part and having a case internal surface which defines a receiving space, the case having a front wall opposing to the joint hollow needle, the front wall having a front wall internal surface which defines a first associating hole opposing to the joint hollow needle, the first associating hole being able to be passed through by the joint hollow needle;

a separating wall formed on a middle part of the case internal surface, the separating wall having a separating wall internal surface which defines a second associating hole which is associated with the receiving space, the second associating hole opposing to the first associating hole, the second associating hole being able to be passed through by the joint hollow needle;

a first separating wall side surface of the separating wall and a first part of the case internal surface defining an ink receiving space, a second separating wall side surface of the separating wall and a second part of the case internal surface defining a leak ink accepting space which is associated with the first and second associating holes and the ink receiving space;

an ink receiving bag positioned in the ink receiving space for receiving an ink, a front part of the ink receiving bag being able to be passed through by the joint hollow needle;

a joint film having elasticity and formed on the separating wall internal surface to be positioned in the second associating hole, the joint film being able to be passed through by the joint hollow needle; and a leak ink accepting member positioned in the leak ink accepting space for absorbing and holding a leak ink from the ink receiving bag, the leak ink accepting member being able to be passed through by the joint hollow needle.

According to a fifth aspect of this invention, there is provided an ink cartridge which is attached to a cartridge attaching part having a joint hollow needle which is associated with a recording head, the ink cartridge comprising:

a case attached to the cartridge attaching part and having a case internal surface which defines a receiving space, the case having a front wall opposing to the joint hollow needle, the front wall having a front wall internal surface which defines a first associating hole opposing to the joint hollow needle, the first associating hole being able to be passed through by the joint hollow needle;

a separating wall formed on a middle part of the case internal surface, the separating wall having a separating wall internal surface which defines a second associating hole which is associated with the receiving space, the second associating hole opposing to the first associating hole, the second associating hole being able to be passed through by the joint hollow needle; a first separating wall side surface of the separating wall and a first part of the case internal surface defining an ink receiving space, a second separating wall side surface of the separating wall and a second part of the case internal surface defining a leak ink accepting space which is associated with the first and second associating holes and the ink receiving space;

an ink receiving bag positioned in the ink receiving space for receiving an ink, a front part of the ink receiving bag being able to be passed through by the joint hollow needle;

a joint film having elasticity and formed on the separating wall internal surface to be positioned in the second associating hole, the joint film being able to be passed through by the joint hollow needle; and an ink cleaning film having elasticity and water repellent and formed on the front wall internal surface to be positioned in the first associating hole, the ink cleaning film being able to be passed through by the joint hollow needle, the ink cleaning film cleaning the joint hollow needle when the joint hollow needle is extracted from the ink cleaning film.

According to a sixth aspect of this invention, there is provided an ink cartridge which is attached to a cartridge attaching part having a joint hollow needle which is associated with a recording head, the ink cartridge comprising:

a case attached to the cartridge attaching part and having a case internal surface which defines a receiving space, the case having a front wall opposing to the joint hollow needle, the front wall having a front wall internal surface which defines a first associating hole opposing to the joint hollow needle, the first associating hole being able to be passed through by the joint hollow needle;

a separating wall formed on a middle part of the case internal surface, the separating wall having a separating wall internal surface which defines a second associating hole which is associated with the receiving space, the second associating hole opposing to the first associating hole, the second associating hole being able to be passed through by the joint hollow needle; a first separating wall side surface of the separating wall and a first part of the case internal surface defining an ink receiving space, a second separating wall side surface of the separating wall and a second part of the case internal surface defining a leak ink accepting space which is associated with the first and second associating holes and the ink receiving space;

an ink receiving bag positioned in the ink receiving space for receiving an ink, a front part of the ink receiving bag being able to be passed through by the joint hollow needle;

a joint film having elasticity and formed on the separating wall internal surface to be positioned in the second associating hole, the joint film being able to be passed through by the joint hollow needle;

a leak ink accepting member positioned in the leak ink accepting space for absorbing and holding a leak ink from the ink receiving bag, the leak ink accepting member being able to be passed through by the joint hollow needle; and an ink cleaning film having elasticity and water repellent and formed on the front wall internal surface to be positioned in the first associating hole, the ink cleaning film being able to be passed through by the joint hollow needle, the ink cleaning film cleaning the joint hollow needle when the joint hollow needle is extracted from the ink cleaning film.

BRIEF DESCRIPTION OH THE DRAWINGS

DESCRIPTION OF THE PREFERRED EMBODIMENTS

Figure 1:
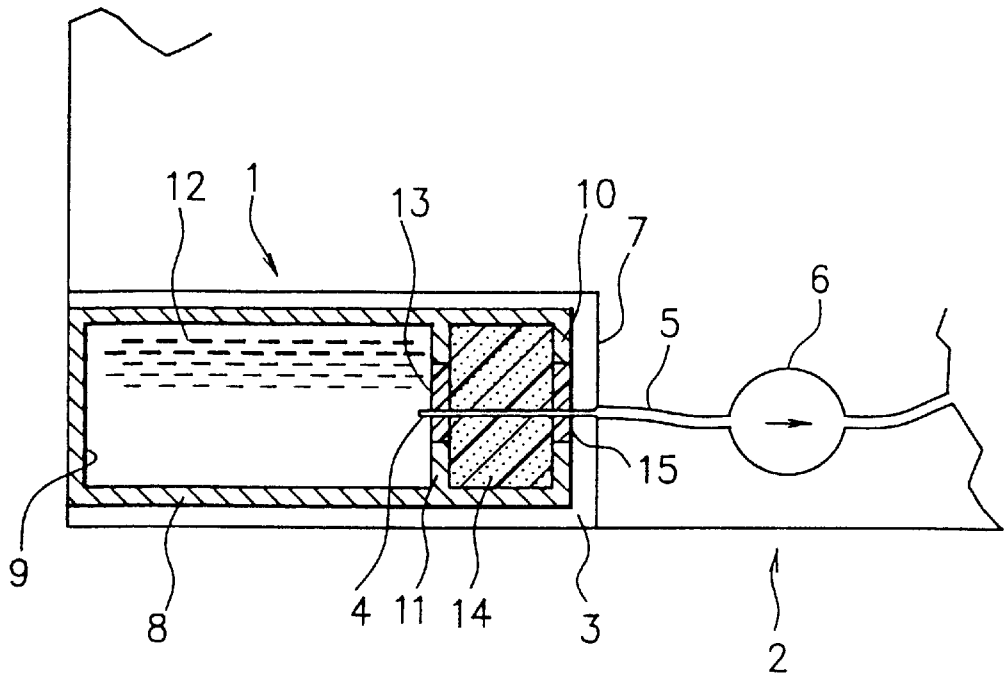
FIG. 1 is a schematic vertical cross-sectional view of an ink cartridge according to a first embodiment of this invention.
Figure 2:
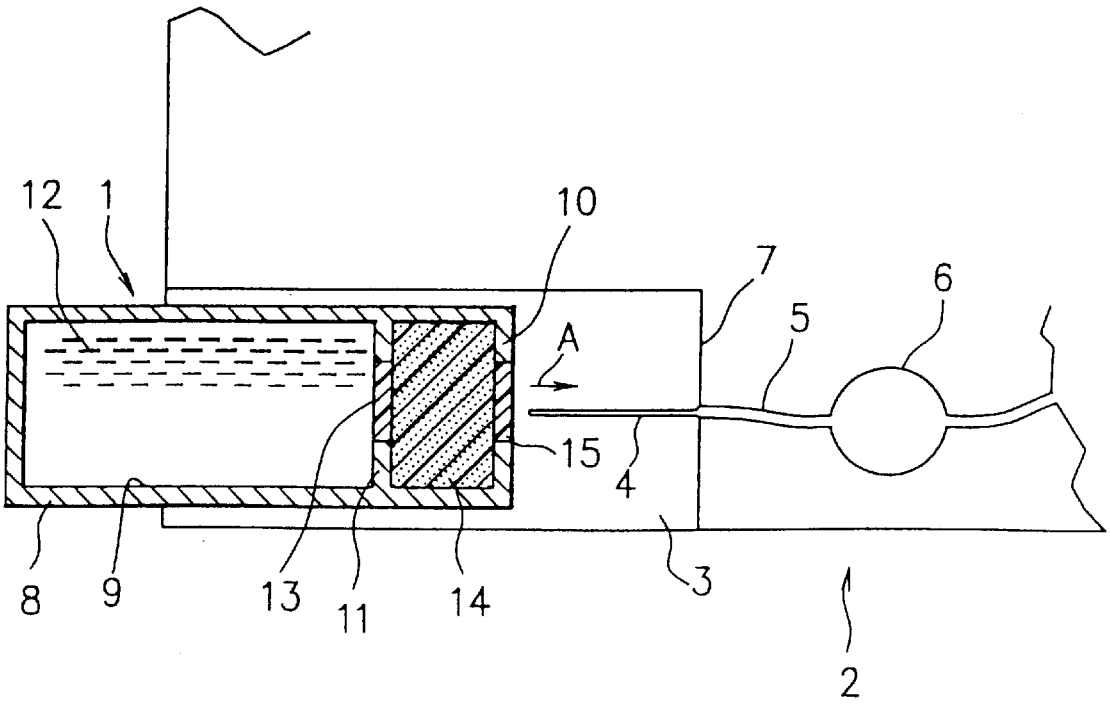
FIG. 2 is another schematic vertical cross-sectional view for describing an operation of the ink cartridge illustrated in FIG. 1.

Referring to FIGS. 1 and 2, an ink cartridge according to a first embodiment of this invention is shown. In FIG. 1, the ink cartridge 1 is attached to a recording device 2. The recording device 2 comprises a cartridge attaching part 3, a joint hollow needle 4, an ink supplying tube 5, a pumping device 6, and a recording head (not shown). The cartridge attaching part 3 has the joint hollow needle 4 which is associated with the recording head (not shown) through the ink supplying tube 5. The cartridge attaching part 3 has a cartridge attaching surface 7 which defines a cartridge attaching space. The ink supplying tube 5 is protruded in the cartridge attaching space. The ink cartridge 1 is attached in the cartridge attaching space. The pumping device 6 is installed to the ink supplying tube 5.

The ink cartridge 1 comprises a case 8 which is attached to the cartridge attaching part 3. The case 8 has a case internal surface 9 which defines a receiving space. The case 8 has a front wall 10 which opposes to the joint hollow needle 4. The front wall 10 has a front wall internal surface which defines a first associating hole opposing to the joint hollow needle 4. The first associating hole is able to be passed through by the joint hollow needle 4.

A separating wall 11 is formed on a middle part of the case internal surface 9. The separating wall 11 has a separating wall internal surface which defines a second associating hole. The second associating hole is associated with the receiving space. The second associating hole opposes to the first associating hole. The second associating hole is able to be passed through by the joint hollow needle 4. A first separating wall side surface of the separating wall 11 and a first part of the case internal surface 9 defines an ink receiving space which receives an ink 12. A second separating wall side surface of the separating wall 11 and a second part of the case internal surface 9 defines a leak ink accepting space which is associated with the first and second associating holes and the ink receiving space.

A joint film 13 is formed on the separating wall internal surface to be positioned in the second associating hole. The joint film 13 has elasticity. The joint film 13 is able to be passed through by the joint hollow needle 4. When the joint hollow needle 4 is extracted from the joint film 13, the joint film 13 is able to close, by an elastic recovery force, an opening hole which is made by the joint hollow needle 4. A leak ink accepting member 14 is positioned in the leak ink accepting space. The leak ink accepting member 14 has a function for absorbing and holding a leak ink from the ink receiving space. The leak ink accepting member 14 is able to be passed through by the joint hollow needle 4.

An ink cleaning film 15 is formed on the front wall internal surface to be positioned in the first associating hole. The ink cleaning film 15 has elasticity and water repellent. The ink cleaning film 15 is able to be passed through by the joint hollow needle 4. The ink cleaning film 15 cleans the joint hollow needle 4 when the joint hollow needle 4 is extracted from the ink cleaning film 15. When the joint hollow needle 4 is extracted from the ink cleaning film 15, the ink cleaning film 15 is able to close, by an elastic recovery force, an opening hole which is made by the joint hollow needle 4.

Referring to FIG. 2 together with FIG. 1, the description will proceed to an operation of the ink cartridge 1. In FIG. 2, the ink cartridge 1 is moved in a direction to the cartridge attaching part 3 as shown by an arrow A. When the ink cartridge 1 further is moved in the direction to the cartridge attaching part 3 as shown by the arrow A, the ink cleaning film 15, the leak ink accepting member 14, and the joint film 13 are passed through by the joint hollow needle 4 as shown in FIG. 1. In this event, a front head of the joint hollow needle 4 is positioned in the ink receiving space which receives the ink 12, namely, the ink cartridge 1 is attached to the cartridge attaching part 3. As a result, the ink 12 of in the ink receiving space is supplied to the recording head through the joint hollow needle 4 and the ink supplying tube 5.

On the other hand, when the ink cartridge 1 is moved in a direction opposite to the cartridge attaching part 3, the joint hollow needle 4 is extracted from the joint film 13, the leak ink accepting member 14, and the ink cleaning film 15. In this event, the opening holes of the joint film 13 and the ink cleaning film 15 that are made by the joint hollow needle 4 are closed by the elastic recovery forces. In addition, the leak ink accepting member 14 absorbs and holds the leak ink from the ink receiving space. Thereby, it is possible to prevent leak of the ink 12 of the ink cartridge 1. Therefore, it is possible to prevent pollution of an internal of the ink cartridge 1 and a body and a clothes of a user.

Figure 3:
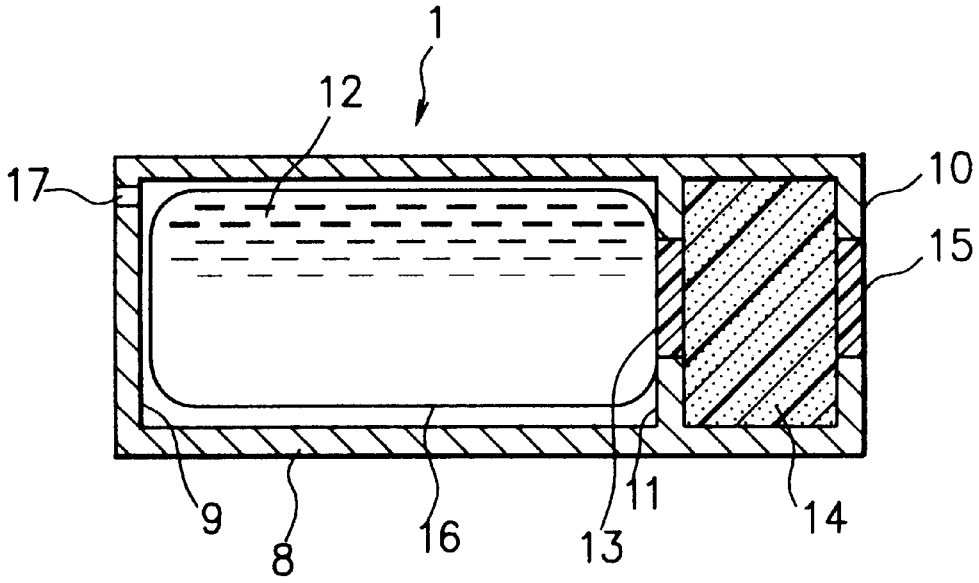
FIG. 3 is a schematic vertical cross-sectional view of an ink cartridge according to a second embodiment of this invention.

Referring to FIG. 3, the description will proceed to an ink cartridge according to a second embodiment of this invention. Similar parts are designated by like reference numerals. The ink cartridge 1 further comprises an ink receiving bag 16 which is positioned in the ink receiving space. Namely, the ink cartridge 1 comprises the case 8, the separating wall 11, the joint film 13, the leak ink accepting member 14, the ink cleaning film 15, and the ink receiving bag 16. The ink receiving bag 16 receives the ink 12. A front part of the ink receiving bag 16 that opposes to the joint hollow needle 4 is able to be passed through by the joint hollow needle 4.

When the ink cartridge 1 is attached to the cartridge attaching part 3, the ink cleaning film 15, the leak ink accepting member 14, the joint film 13, and the front part of the ink receiving bag 16 are passed through by the joint hollow needle 4. In this event, the front head of the joint hollow needle 4 is positioned in the ink receiving bag 16 which receives the ink 12. The case 8 further has a case wall internal surface 17 which defines a case wall air hole. The case wall air hole is associated with the ink receiving space and with the external atmosphere. When the ink 12 in the ink receiving bag 16 is used, a volume of the ink receiving bag 16 is decreased. In this event, an air of the external atmosphere flows in the ink receiving space through the case wall air hole. As a result, a pressure of the air of the ink receiving space does not become negative.

Figure 4:
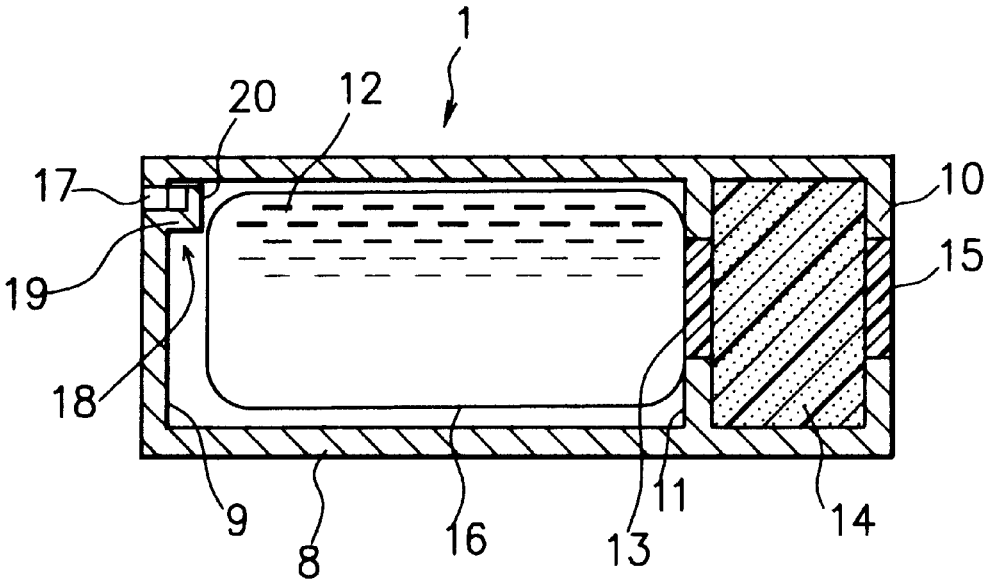
FIG. 4 is a schematic vertical cross-sectional view of an ink cartridge according to a third embodiment of this invention.

Referring to FIG. 4, the description will proceed to an ink cartridge according to a third embodiment of this invention. Similar parts are designated by like reference numerals. The case 8 further has a protruding piece 18 which is formed on the case wall internal surface to be positioned in the ink receiving space in the ink cartridge 1 illustrated in FIG. 3. The protruding piece 18 is formed in a vicinity of the case wall air hole. The protruding piece 18 has a horizontal part 19 and a vertical part 20 which opposes the case wall air hole. The protruding piece 18 prevents irruption of a sharp object to the ink receiving space. Thereby, it is possible to prevent damage of the ink receiving bag 16.

Figure 5:
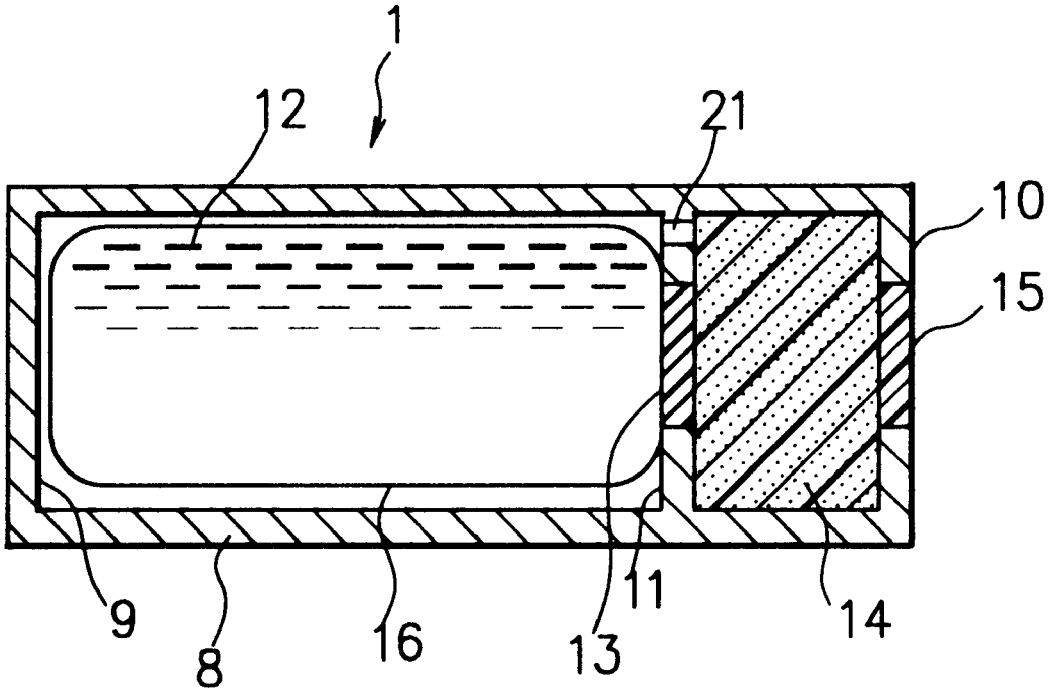
FIG. 5 is a schematic vertical cross-sectional view of an ink cartridge according to a fourth embodiment of this invention.

Referring to FIG. 5, the description will proceed to an ink cartridge according to a fourth embodiment of this invention. Similar parts are designated by like reference numerals. The ink cartridge 1 comprises the separating wall 11 has another separating wall internal surface 21 instead of the case wall internal surface of the case 8. The other separating wall internal surface 21 defines a separating wall air hole which is associated with the ink receiving space and with the leak ink accepting space. Thereby, the pressure of the air of the ink receiving space does not become negative. Also, it is possible to prevent damage of the ink receiving bag 16 that is caused by the sharp object.

While this invention has thus far been described in conjunction with a few preferred embodiments thereof, it will readily be possible for those skilled in the art to put this invention into practice in various other manners. For example, a volume the leak ink accepting member 14 is set to absorb and hold a whole amount of the ink 12 in the ink receiving bag 16 that is not used. Thereby, when damage or burst of the ink receiving bag 16 is caused, it is possible to prevent leak of the ink in the ink cartridge 1.

Also, the leak ink accepting member 14 may be positioned in a space which is defined by the case internal surface 9 and an external surface of the ink receiving bag 16. In this event, the leak ink accepting member 14 may cover the whole external surface or at least bottom of the ink receiving bag 16. Thereby, when damage or burst of the ink receiving bag 16 is caused, the leak ink accepting member 14 may absorb the ink which is leaked from the ink receiving bag 16. A blade spring (not shown) may be positioned between the ink receiving bag 16 and the first part of the case internal surface so that the blade spring compresses the ink receiving bag 16. Thereby, it is easily possible to supply the ink 12 in the receiving bag 16 to the joint hollow needle 4. An ink remained amount detector (not shown) may be positioned in a passage of the ink. The ink remained amount detector detects a remained amount of the ink 12 in the ink cartridge 1. An ink remained amount announcing device (not shown) may be mounted on an outside part of the case 8. The ink remained amount announcing device is connected to the ink remained amount detector. When the ink remained amount announcing device is supplied with a detecting signal from the ink remained amount detector, the ink remained amount announcing device announces the remained amount of the ink 12 in the ink cartridge 1 to a user. Also, the leak ink accepting member 14 may be omitted. In addition, the ink cleaning film 15 may be omitted.

What is claimed is:

1. An ink cartridge which is attached to a cartridge attaching part having a joint hollow needle which is associated with a recording head, said ink cartridge comprising:

a case attached to said cartridge attaching part and having a case internal surface which defines a receiving space, said case having a front wall opposing to said joint hollow needle, said front wall having a front wall internal surface which defines a first associating hole opposing to said joint hollow needle, said first associating hole disposed to accept said joint hollow needle;

a separating wall formed on said case internal surface, said separating wall having a separating wall internal surface which defines a second associating hole which is associated with said receiving space, said second associating hole opposing to said first associating hole, said second associating hole disposed to accept said joint hollow needle;

a first separating wall side surface of said separating wall and a first part of said case internal surface defining an ink receiving space which receives an ink, a second separating wall side surface of said separating wall and a second part of said case internal surface defining a leak ink accepting space which is associated with said first and second associating holes and said ink receiving space; and a joint film having elasticity and formed on said separating wall internal surface to be positioned in said second associating hole, said joint film disposed to accept said joint hollow needle; and an ink cleaning film having elasticity and water repellent and formed on said front wall internal surface to be positioned in said first associating hole, said ink cleaning film disposed to accept said joint hollow needle, said ink cleaning film cleaning said joint hollow needle when said joint hollow needle is extracted from said ink cleaning film.

2. An ink cartridge which is attached to a cartridge attaching part having a joint hollow needle which is associated with a recording head, said ink cartridge comprising:

a case attached to said cartridge attaching part and having a case internal surface which defines a receiving space, said case having a front wall opposing to said joint hollow needle, said front wall having a front wall internal surface which defines a first associating hole opposing to said joint hollow needle, said first associating hole disposed to accept said joint hollow needle;

a separating wall formed on said case internal surface, said separating wall having a separating wall internal surface which defines a second associating hole which is associated with said receiving space, said second associating hole opposing to said first associating hole, said second associating hole disposed to accept said joint hollow needle;

a first separating wall side surface of said separating wall and a first part of said case internal surface defining an ink receiving space which receives an ink, a second separating wall side surface of said separating wall and a second part of said case internal surface defining a leak ink accepting space which is associated with said first and second associating holes and said ink receiving space; and a joint film having elasticity and formed on said separating wall internal surface to be positioned in said second associating hole, said joint film disposed to accept said joint hollow needle;

a leak ink accepting member positioned in said leak ink accepting space for absorbing and holding a leak ink from said ink receiving space, said leak ink accepting member disposed to accept said joint hollow needle; and an ink cleaning film having elasticity and water repellent and formed on said front wall internal surface to be positioned in said first associating hole, said ink cleaning film disposed to accept said joint hollow needle, said ink cleaning film cleaning said joint hollow needle when said joint hollow needle is extracted from said ink cleaning film.

3. An ink cartridge which is attached to a cartridge attaching part having a joint hollow needle which is associated with a recording head, said ink cartridge comprising:

a case attached to said cartridge attaching part and having a case internal surface which defines a receiving space, said case having a front wall opposing to said joint hollow needle, said front wall having a front wall internal surface which defines a first associating hole opposing to said joint hollow needle, said first associating hole disposed to accept said joint hollow needle;

a separating wall formed on said case internal surface, said separating wall having a separating wall internal surface which defines a second associating hole, which is associated with said receiving space, said second associating hole opposing to said first associating hole, said second associating disposed to accept said joint hollow needle;

a first separating wall side surface of said separating wall and a first part of said case internal surface defining an ink receiving space, a second separating wall side surface of said separating wall and a second part of said case internal surface defining a leak ink accepting space which is associated with said first and second associating holes and said ink receiving space;

an ink receiving bag positioned in said ink receiving space for receiving an ink, a front part of said ink receiving bag disposed to accept said joint hollow needle;

a joint film having elasticity and formed on said separating wall internal surface to be positioned in said second associating hole, said joint film disposed to accept said joint hollow needle;

a leak ink accepting member positioned in said leak ink accepting space for absorbing and holding a leak ink from said ink receiving bag, said leak ink accepting member disposed to accept said joint hollow needle; and wherein said separating wall has another separating wall internal surface which defines a separating wall air hole, said separating wall air hole being associate with said ink receiving space and with said leak ink accepting space.

4. An ink cartridge as claimed in claim 3, wherein said case further has a case wall internal surface which defines an case wall air hole, said case wall air hole being associated with said ink receiving space and with an external atmosphere.

5. An ink cartridge which is attached to a cartridge attaching part having a joint hollow needle which is associated with a recording head, said ink cartridge comprising:

a case attached to said cartridge attaching part and having a case internal surface which defines a receiving space, said case having a front wall opposing to said joint hollow needle, said front wall having a front wall internal surface which defines a first associating hole opposing to said joint hollow needle, said first associating hole disposed to accept said joint hollow needle;

a separating wall formed on said case internal surface, said separating wall having a separating wall internal surface which defines a second associating hole which is associated with said receiving space, said second associating hole opposing to said first associating hole, said second associating hole disposed to accept said joint hollow needle;

a first separating wall side surface of said separating wall and a first part of said case internal surface defining an ink receiving space, a second separating wall side surface of said separating wall and a second part of said case internal surface defining a leak ink accepting space which is associated with said first and second associating holes and said ink receiving space;

an ink receiving bag positioned in said ink receiving space for receiving an ink, a front part of said ink receiving bag disposed to accept said joint hollow needle;

a joint film having elasticity and formed on said separating wall internal surface to be positioned in said second associating hole, said joint film disposed to accept said joint hollow needle; and an ink cleaning film having elasticity and water repellent and formed on said front wall internal surface to be positioned in said first associating hole, said ink cleaning film disposed to accept said joint hollow needle, said ink cleaning film cleaning said joint hollow needle when said joint hollow needle is extracted from said ink cleaning film.

6. An ink cartridge as claimed in claim 5, wherein said case further has a case wall internal surface which defines an case wall air hole, said case wall air hole being associated with said ink receiving space and with an external atmosphere.

7. An ink cartridge as claimed in claim 5, wherein said separating wall has another separating wall internal surface which defines a separating wall air hole, said separating wall air hole being associated with said ink receiving space and with said leak ink accepting space.

8. An ink cartridge which is attached to a cartridge attaching part having a joint hollow needle which is associated with a recording head, said ink cartridge comprising:

a case attached to said cartridge attaching part and having a case internal surface which defines a receiving space, said case having a front wall opposing to said joint hollow needle, said front wall having a front wall internal surface which defines a first associating hole opposing to said joint hollow needle, said first associating hole disposed to accept said joint hollow needle;

a separating wall formed on said case internal surface, said separating wall having a separating wall internal surface which defines a second associating hole which is associated with said receiving space, said second associating hole opposing to said first associating hole, said second associating hole disposed to accept said joint hollow needle;

a first separating wall side surface of said separating wall and a first part of said case internal surface defining an ink receiving space, a second separating wall side surface of said separating wall and a second part of said case internal surface defining a leak ink accepting space which is associated with said first and second associating holes and said ink receiving space;

an ink receiving bag positioned in said ink receiving space for receiving an ink, a front part of said ink receiving bag disposed to accept said joint hollow needle;

a joint film having elasticity and formed on said separating wall internal surface to be positioned in said second associating hole, said joint film disposed to accept said joint hollow needle;

a leak ink accepting member positioned in said leak ink accepting space for absorbing and holding a leak ink from said ink receiving bag, said leak ink accepting member disposed to accept said joint hollow needle; and an ink cleaning film having elasticity and water repellent and formed on said front wall internal surface to be positioned in said first associating hole, said ink cleaning film disposed to accept said joint hollow needle, said ink cleaning film cleaning said joint hollow needle when said joint hollow needle is extracted from said ink cleaning film.

9. An ink cartridge as claimed in claim 8, wherein said case further has a case wall internal surface which defines an case wall air hole, said case wall air hole being associated with said ink receiving space and with an external atmosphere.

10. An ink cartridge as claimed in claim 8, wherein said separating wall has another separating wall internal surface which defines a separating wall air hole, said separating wall air hole being associated with said ink receiving space and with said leak ink accepting space.

11. An ink cartridge, comprising:

a case having an interior region defined by an internal surface of said case, said case having a front wall that accepts insertion of a hollow needle;

a separating wall disposed within said interior region of said case to partition said interior region into an ink receiving space and a leak ink accepting space, wherein said leak ink accepting space is between said front wall and said ink receiving space;

a joint film disposed on said separating wall between said ink receiving space and said leak ink accepting space;

wherein said separating wall includes a separating wall air hole disposed between said ink receiving space and said leak ink accepting space; and a receiving bag is disposed within said ink receiving space.

12. The ink cartridge of claim 11, wherein said leak ink accepting space contains a leak ink accepting member that absorbs ink.

13. The ink cartridge of claim 11, wherein said joint film is elastic to close a hole made therein by extracting a hollow needle therefrom.

14. The ink cartridge of claim 11, further comprising:

an air hole between said ink receiving space and an exterior portion of said case.

15. The ink cartridge of claim 14, further comprising:

a protruding piece disposed proximal to said air hole to prevent eruption of a sharp object to said ink receiving space.

16. An ink cartridge, comprising:

a case having an interior region defined by an internal surface of said case, said case having a front wall that accepts insertion of a hollow needle;

a separating wall disposed within said interior region of said case to partition said interior region into an ink receiving space and a leak ink accepting space, wherein said leak ink accepting space is between said front wall and said ink receiving space;

a joint film disposed on said separating wall between said ink receiving space and said leak ink accepting space; and an ink cleaning film disposed on said front wall to clean a hollow needle extracted therefrom.

17. The ink cartridge of claim 16, wherein said ink cleaning film is elastic to close an opening hole made therein when the hollow needle extracted therefrom.

18. The ink cartridge of claim 17, wherein said ink cleaning film is water repellant.

19. A method of using an ink cartridge, comprising:

providing a hollow needle for supplying ink to a recording device;

providing an ink cartridge having a case with an interior region defined by an internal surface thereof and a front wall that accepts insertion of the hollow needle, a separating wall formed on the internal surface that partitions the interior region into an ink receiving space and a leak ink accepting space that is between the front wall and the ink receiving space, and a joint film dispose on the separating wall between the ink receiving space and the leak ink accepting space;

inserting the hollow needle into the ink receiving space through the leak ink accepting space and the joint film;

supplying ink to the recording device through the hollow needle;

extracting the hollow needle from the ink receiving space, the joint film, and the leak ink accepting space; and further comprising:

after extracting the hollow needle, an ink cleaning film disposed on the front wall closing an opening hole made by the hollow needle; and the ink cleaning film cleaning the hollow needle.

20. The method of claim 19, further comprising:

after extracting the hollow needle, the joint film closing an opening hole made by the hollow needle.

21. The method of claim 19, further comprising:

after extracting the hollow needle, a leak accepting member, disposed with the leak ink accepting space, absorbing ink leaked into the leak ink accepting space.

* * * * *